US005996882A

United States Patent [19]

Randall

[11] Patent Number: 5,996,882

[45] Date of Patent: Dec. 7, 1999

[54] COLLAPSIBLE, FOLDABLE, STACKABLE, AND SELF-SUPPORTING CONTAINER

[75] Inventor: Catherine Jean Randall, Cincinnati, Ohio

[73] Assignee: The Procter & Gamble Company, Cincinnati, Ohio

[21] Appl. No.: 08/853,773

[22] Filed: May 9, 1997

[51] Int. Cl.[6] ..... B65D 5/36

[52] U.S. Cl. ..... 229/117.05; 383/120; 229/125.13

[58] Field of Search ..... 229/117.05, 117.04, 229/117.01, 125.13, 160.2; 220/359; 383/33, 120, 78, 80, 81, 210, 211

[56] References Cited

U.S. PATENT DOCUMENTS

| | | | |
|---|---|---|---|
| 584,555 | 6/1897 | Lorenz . | |
| 605,343 | 6/1898 | Ross . | |
| 2,573,309 | 10/1951 | Chipkevich . | |
| 2,893,295 | 7/1959 | Magill | 229/117.01 X |
| 2,951,765 | 9/1960 | Robson . | |
| 3,197,062 | 7/1965 | Day et al. . | |
| 3,306,492 | 2/1967 | Kugler . | |
| 3,319,684 | 5/1967 | Calhoun . | |
| 3,462,067 | 8/1969 | Shore . | |
| 3,682,372 | 8/1972 | Rodley . | |
| 3,738,565 | 6/1973 | Ackley et al. . | |
| 3,784,055 | 1/1974 | Anderson . | |
| 3,819,043 | 6/1974 | Harrison . | |
| 3,970,241 | 7/1976 | Hanson . | |
| 4,131,195 | 12/1978 | Worrell, Sr. . | |
| 4,183,458 | 1/1980 | Meyers | 229/125.08 X |
| 4,185,754 | 1/1980 | Julius . | |
| 4,411,374 | 10/1983 | Hotchkiss . | |
| 4,420,080 | 12/1983 | Nakamura . | |
| 4,458,810 | 7/1984 | Mahoney . | |
| 4,487,318 | 12/1984 | Roen . | |
| 4,540,091 | 9/1985 | Haböck . | |
| 4,571,337 | 2/1986 | Cage et al. . | |
| 4,681,240 | 7/1987 | Wyant . | |
| 4,735,317 | 4/1988 | Sussman et al. . | |
| 4,736,450 | 4/1988 | Van Erden et al. . | |
| 4,753,351 | 6/1988 | Guillin | 229/160.2 X |
| 4,790,436 | 12/1988 | Nakamura . | |
| 4,808,421 | 2/1989 | Mendenhall et al. . | |

(List continued on next page.)

*Primary Examiner*—Gary E. Elkins
*Assistant Examiner*—Tri M. Mai
*Attorney, Agent, or Firm*—William Scott Andes

[57] ABSTRACT

The present invention provides a collapsible, foldable, stackable, and self-restorable container comprising semi-enclosed container body having two opposed side walls, two opposed end walls between the side walls, and a bottom panel enclosing one end of the container body. Each of the side walls includes a gusset extending in a direction substantially parallel to the bottom panel. The container further includes a lid attached to the container body for selectively converting the semi-enclosed container to a closed container. Finally, the container includes a closure means for sealing the lid to the container body. In accordance with the present invention the side walls and end walls are inwardly foldable toward one another, such that the container is collapsible in a direction normal to the lid and bottom panel while being substantially self-supporting while the side walls and end walls are in their unfolded orientation. The present invention also provides a storage container having an opening and a closure means for sealing the opening to convert the semi-enclosed container to a closed container. The closure means comprises a strip of material forming at least a portion of the periphery of the opening having a first side facing inwardly toward the opening and a second side facing outwardly of the opening. The first side exhibits an adhesion peel force after activation by a user which is greater than an adhesion peel force exhibited prior to activation by a user. Accordingly, the storage containers of the present invention combine the desirable qualities of both flexible bags and storage containers and minimize the less desirable qualities of both approaches by providing improved sealability, being self-supporting in an open condition for filling, storing easily by folding into a compact form, and being unitarily constructed from inexpensive materials to promote disposability and obviate the need for separate closure devices.

22 Claims, 3 Drawing Sheets

U.S. PATENT DOCUMENTS 4,833,862 5/1989 Bortolani et al. .
4,848,930 7/1989 Williams et al. .
4,863,064 9/1989 Dailey, III .
4,892,220 1/1990 Foos ..... 229/160.2 X
4,898,477 2/1990 Cox et al. .
4,930,644 6/1990 Robbins, III .
4,979,613 12/1990 McLaughlin et al. .
5,044,774 9/1991 Bullard et al. .
5,048,718 9/1991 Nakamura .
5,050,737 9/1991 Joslyn et al. .
5,061,500 10/1991 Mendenhall .
5,076,436 12/1991 Bortolani et al. .
5,145,091 9/1992 Meyers .
5,195,829 3/1993 Watkins et al. .
5,201,164 4/1993 Kaufman .
5,242,057 9/1993 Cook et al. .
5,314,252 5/1994 Happ .
5,364,189 11/1994 Kuge et al. .
5,379,897 1/1995 Muckenfuhs et al. .
5,507,579 4/1996 Sorenson .
5,524,990 6/1996 Buck .
5,547,284 8/1996 Imer .
5,575,747 11/1996 Dais et al. .
5,605,594 2/1997 May .
5,609,899 3/1997 Spector ..... 229/117.01 X

COLLAPSIBLE, FOLDABLE, STACKABLE, AND SELF-SUPPORTING CONTAINER

FIELD OF THE INVENTION

The present invention relates to storage containers, particularly those suitable for use in the containment and protection of various items including perishable materials. The present invention further relates to such storage containers having improved sealability for containment and protection of items contained within under a wide range of in-use conditions.

BACKGROUND OF THE INVENTION

Flexible storage bags for use in the containment and protection of various items, as well as the preservation of perishable materials such as food items, are well known in the art. Such bags typically comprise a rectangular sheet of polymeric film folded upon itself and sealed along two edges to form a semi-enclosed container having two flexible opposed sidewalls, three sealed or folded edges, and one open edge. A closure integrally formed with the bag such as an interlocking rib-type seal or separately provided such as a plastic or paper-clad-wire tie completes the containment assembly.

As utilized herein, the term "flexible" is utilized to refer to materials which are capable of being flexed or bent, especially repeatedly, such that they are pliant and yieldable in response to externally applied forces. Accordingly, "flexible" is substantially opposite in meaning to the terms inflexible, rigid, or unyielding. Materials and structures which are flexible, therefore, may be altered in shape and structure to accommodate external forces and to conform to the shape of objects brought into contact with them without losing their integrity. Flexible storage bags of the foregoing variety are typically formed from polymeric film, such as polyethylene or other members of the polyolefin family, in thicknesses of between about 0.0002 inches to about 0.002 inches. Such films are frequently transparent but sometimes are opaque and/or colored.

Flexible storage bags of the currently commercially available variety provide a means of conveniently storing a wide range of objects and materials in a generally disposable containment device. While flexible storage bags of the foregoing variety have enjoyed a fair degree of commercial success, their reliance upon mechanical closures tends to cause difficulty in operation for individuals having impaired manual dexterity such as children, the elderly, arthritis patients, etc. Moreover, such mechanical closures typically require alignment of mechanical elements for operation which can prove challenging for those with impaired vision or impaired hand-eye coordination. Many mechanical closure mechanisms also provide leakage sites at such locations as the end of interlocking channels where liquid or gases can leak into or out of the bag.

In an attempt to address this issue alternative closure mechanisms have been developed which rely upon strips or regions of adhesive to bond superimposed regions of the bag. While these closures address some of the difficulties in utilizing separate closure elements or interlocking mechanical elements, some adhesive closure mechanisms require removable liners to protect the adhesive from premature activation, thus adding additional elements for assembly and an additional activation step before use. Moreover, some protected adhesive configurations require interlocking grooves, channels, or protrusions which must be properly registered to engage the adhesive, thus again raising the visual and coordination requirements of conventional mechanical closure mechanisms.

While such flexible storage bags are generally highly efficient for storage before use, for many storage situations it is desirable to minimize the amount of air and/or free space above or around the contents which is trapped within the bag after closure to minimize storage space of filled bags and to aid the effectiveness of the bag in preservation of perishable items. Notwithstanding the type of closure mechanism employed, it is often difficult with conventional flexible storage bags to only partially close the bag and expel trapped air before completing the closure as this again requires a certain amount of manual dexterity and visual aptitude.

Conventional flexible storage bags also create an inherent challenge in terms of being able to hold the flexible or flaccid bag in an open condition with at most one hand so that the other hand can manipulate another container to pour the contents into the bag or peel, cut, or trim items for insertion into the bag. It is also difficult to maintain the proper (usually upright) orientation of the opening of the bag during such filling operations. While rigid containers and flaccid containers with reinforced opening perimeters have been developed for such uses, their comparatively higher cost and limited economical disposability leave room for improvement. Notwithstanding the issue of maintaining the container or bag opening in an open condition, there also remains a need for a flexible yet self-standing container with the foregoing attributes to facilitate easy hands-free filling. Flexible storage bags on the other hand which are constructed of more inexpensive materials to promote disposability typically lack the structure necessary for stable stacking of bags after filling.

With regard to rigid or semi-rigid containers, it is well recognized that such containers have also realized a fair degree of commercial success in providing a means for storing a wide variety of contents. Such containers typically have an opening which maintains an open condition for filling and are typically self-supporting with the opening in the proper orientation for filling. Such containers also are frequently provided with flat bottoms and tops to provide stackability. However, such containers are typically constructed of more expensive materials such that disposability is limited. At the same time, the useful life of such containers is limited by damage, soiling, or other degradation naturally occurring in use, including degradation of the typical mechanical closure mechanisms. Storage of such three-dimensional, rigid or semi-rigid containers when empty is also a concern, since they occupy as much volume empty as they do in a filled condition. Due to their comparatively fixed-volume construction, it is also difficult to minimize the amount of air or free space above or around the contents to minimize storage space of filled containers and to aid the effectiveness of the container in preservation of perishable items. Another concern is the task of matching usually-separate lids or closures with their respective containers for use.

Accordingly, it would be desirable to provide a storage container combining the desirable qualities of both flexible bags and storage containers and minimizing the less desirable qualities of both approaches.

More particularly, it would be desirable to provide a storage container having improved sealability in use.

It would also be desirable to provide such a container which is capable of being self-supporting in an open condition for filling purposes, yet stores easily by folding into a compact form.

It would further be desirable to provide a storage container constructed from inexpensive materials to facilitate disposability which still promotes stable stacking of containers in a filled condition.

It would be yet further desirable to provide such a container which provides the foregoing attributes in a convenient unitary form, obviating the need for separate closure devices.

SUMMARY OF THE INVENTION

The present invention provides a collapsible, foldable, stackable, and self-supporting container comprising semi-enclosed container body having two opposed side walls, two opposed end walls between the side walls, and a bottom panel enclosing one end of the container body. Each of the side walls includes a gusset extending in a direction substantially parallel to the bottom panel. The container further includes a lid attached to the container body for selectively converting the semi-enclosed container to a closed container. Finally, the container includes a closure means for sealing the lid to the container body. In accordance with the present invention the side walls and end walls are inwardly foldable toward one another, such that the container is collapsible in a direction normal to the lid and bottom panel while being substantially self-supporting while the side walls and end walls are in their unfolded orientation.

The present invention also provides a storage container having an opening and a closure means for sealing the opening to convert the semi-enclosed container to a closed container. The closure means comprises a strip of material forming at least a portion of the periphery of the opening having a first side facing inwardly toward the opening and a second side facing outwardly of the opening. The first side exhibits an adhesion peel force after activation by a user which is greater than an adhesion peel force exhibited prior to activation by a user.

Accordingly, the storage containers of the present invention combine the desirable qualities of both flexible bags and storage containers and minimize the less desirable qualities of both approaches by providing improved sealability, being self-supporting in an open condition for filling, storing easily by folding into a compact form, and being unitarily constructed from inexpensive materials to promote disposability and obviate the need for separate closure devices.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

Figure 1:
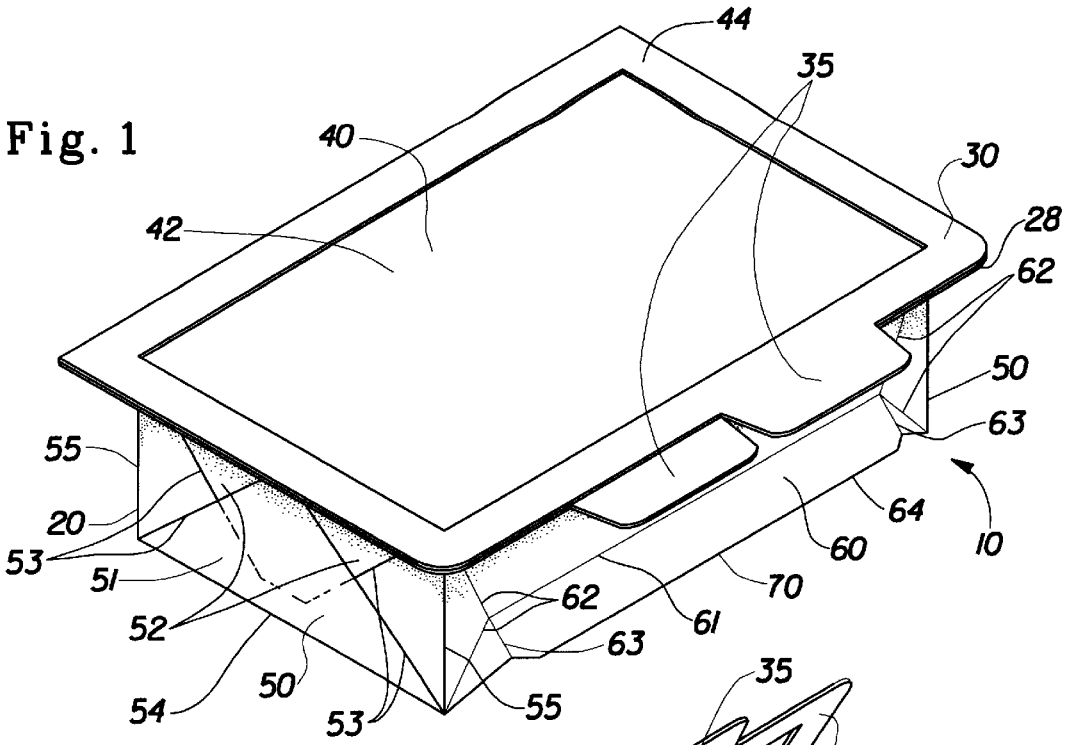
FIG. 1 is a perspective view of a storage container in accordance with the present invention in a closed condition.

FIG. 1 depicts a presently preferred embodiment of a storage container 10 according to the present invention. In the embodiment depicted in FIG. 1, the storage container 10 includes a container body 20 preferably unitarily formed from a piece of sheet material and a lid 40 preferably unitarily formed with the container body 20 or at least hingedly attached to the container body at hinge line 45. Storage container 10 also includes closure means 30 located adjacent to edge 28 for sealing the peripheral portions of the lid 40 and container body 20 to form a fully-enclosed container or vessel as shown in FIG. 1. Closure means 30 may comprise the marginal portion of the lid 40, the marginal flange portion 25 of the container body 20, or both. Closure means 30 is selectively openable, sealable, and resealable, as will be described hereinafter. Hinge line 45 shown in FIG. 2 preferably comprises a unitary living hinge, and may optionally be provided as a line of weakness by scoring, perforations, or the like which may optionally permit the lid to be separated from the container body.

In the preferred configuration depicted in FIG. 1, the closure means 30 completely encircles the periphery of the opening formed by edge 28. However, under some circumstances a closure means formed by a lesser degree of encirelement (such as, for example, a closure means disposed along all portions of edge 28 except the hinged portion at hinge line 45) may provide adequate closure integrity. The flange 25 may be either unitarily formed with the container body 20 or provided as a separate material element joined to the container body. When provided as a separate, preferably more rigid material element, it is presently preferred that the container body material be formed into at least a small peripheral flange at its upper edge (defining the opening) with pleated corners so as to form a suitable junction point for joining the container body to the flange. The closure means may be provided on mating portions of either the flange 25, the lid 40, or both.

Figure 2:
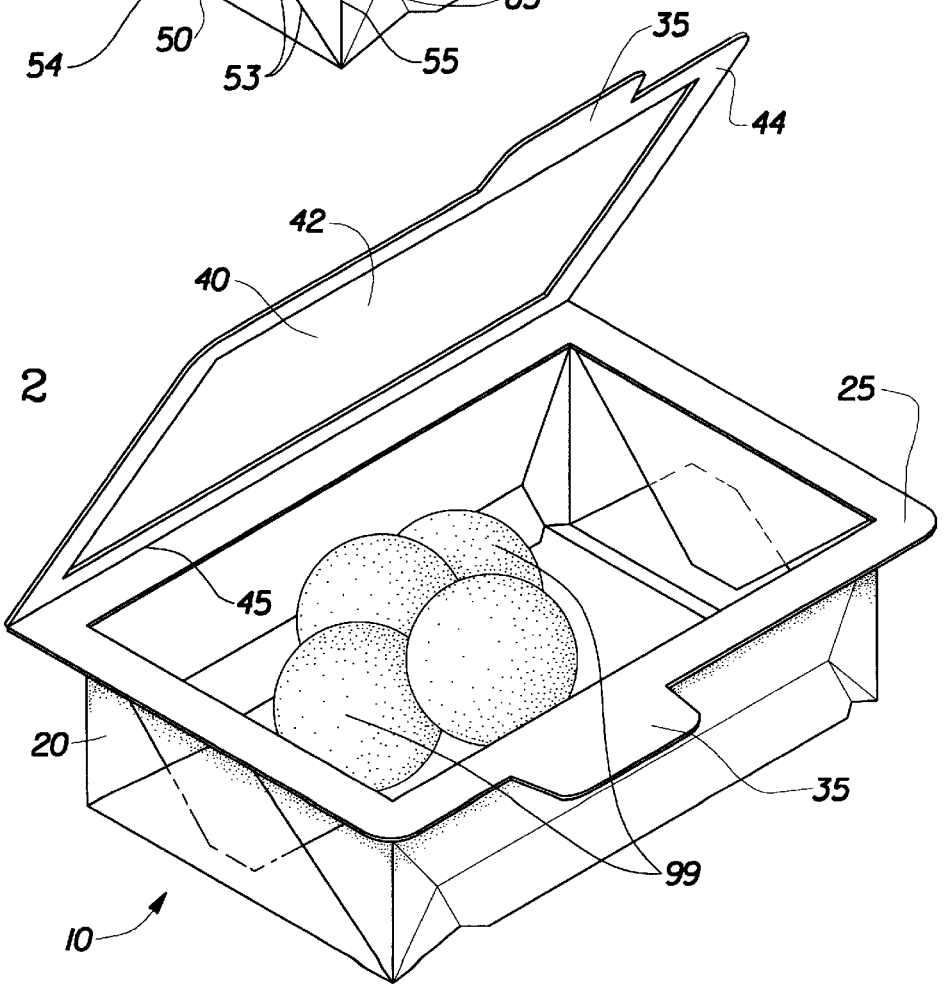
FIG. 2 is a perspective view of the storage container of FIG. 1 in an open condition and partially filled with solid objects.

Storage container 10 is suitable for containing and protecting a wide variety of materials and/or objects contained within the container body. FIG. 2 depicts the storage container 10 in an open condition wherein the closure means 30 has been released such that edge 28 may be opened to admit materials and/or objects into the interior of the body portion of the storage container 10. In FIG. 2 a plurality of generic solid objects 99 are shown within the storage container 10.

The ability to construct the container of multiple composite elements permits the use of diverse materials such as transparent polymeric panels for lid panels or more rigid, resilient materials for flanges and lid frames independently of the tailoring of materials for the container body 20. Lid 40 is depicted as comprising a central lid panel 42 and a lid frame 44, either of which may also formed of various elements if desired, although lid 40 may also be of unitary construction.

In the embodiment of FIG. 1, the storage container 10 comprises two generally planar end panels 50, two generally planar, gusseted side panels 60, and a generally planar bottom panel 70, which panels form a semi-enclosed container having an opening defined by upper flange 25. End panels 50 include side edges 55 and bottom edges 54, while side panels 60 include bottom edges 64 and gussets of generally conventional design having converging base creases 62 and medial creases 61, with lateral creases 63. In the configuration depicted in FIG. 1, the storage container is in its self-supporting, open condition. Flange 25 is preferably sufficiently resilient and rigid to aid in holding the open end of the container in an open condition as shown in FIG. 1.

While the storage container described above with regard to FIG. 1 provides many advantages compared with flexible storage bags and storage containers commonly available, it also includes additional features to enable the container to assume a self-supporting configuration to facilitate product access and product filling without manual support for greater ease of use.

As utilized herein, the term "self-supporting" is utilized to refer to materials, structures, or containers which are capable of maintaining their orientation in a plane parallel to the direction of the force of gravity. For example, a self-supporting material, particularly a sheet material, may be held so that it extends upwardly parallel to the direction of the force of gravity and maintain its orientation without folding over or collapsing. Non-self-supporting materials typically will fold over or collapse and not be capable of being held parallel to the force of gravity (i.e., "vertically") unless they are held so that they extend downwardly from their point of support. Correspondingly, a self-supporting bag or container is capable of maintaining its orientation with surfaces extending upwardly from their base of support in opposition to the force of gravity without folding over upon itself or collapsing.

Figure 3:
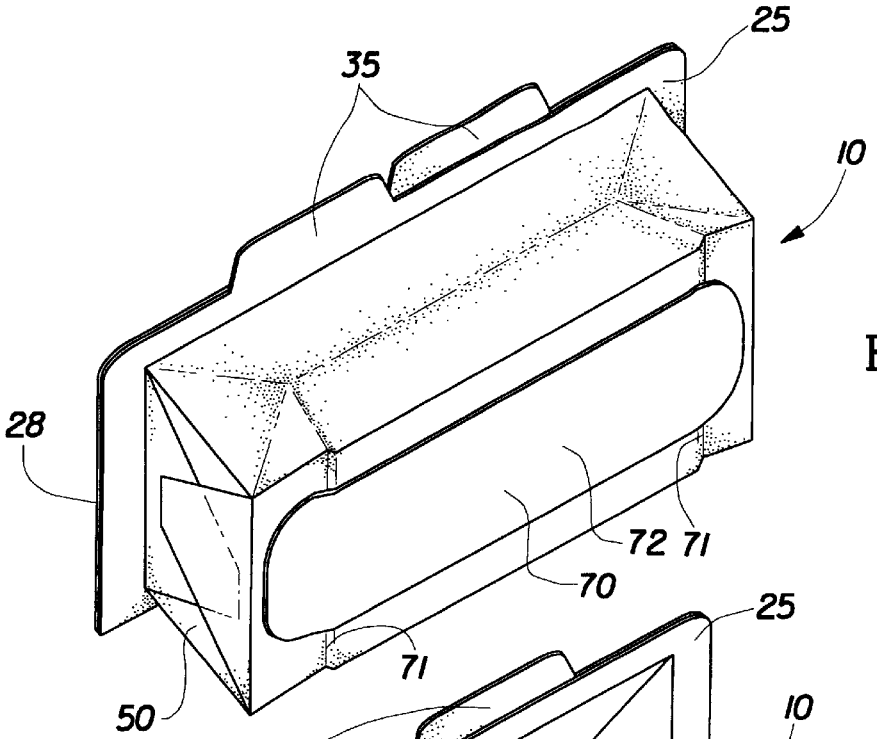
FIG. 3 is a perspective view of the storage container of FIG. 1 in a horizontal position in preparation for folding.
Figure 4:
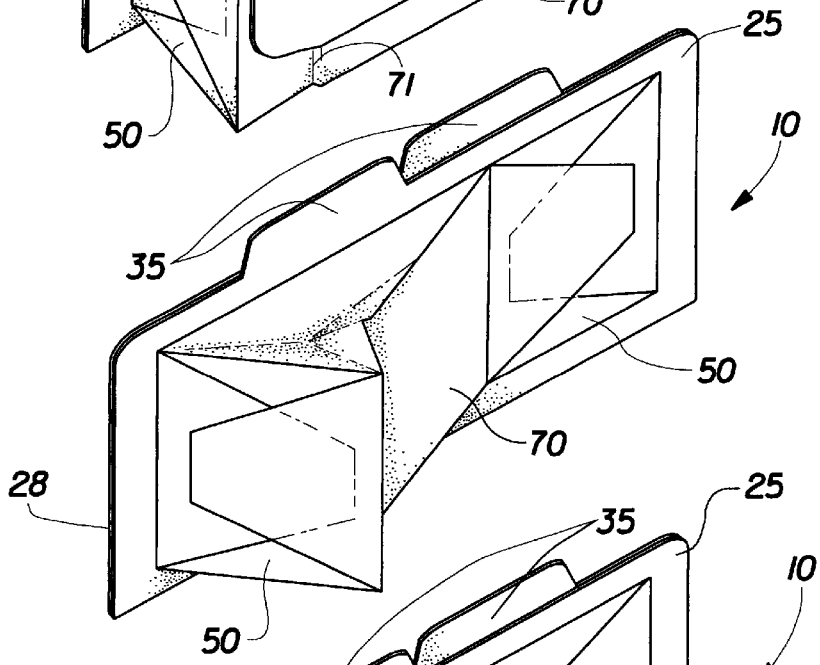
FIG. 4 is a perspective view of the storage container of FIG. 1 in a partially folded and collapsed condition.
Figure 5:
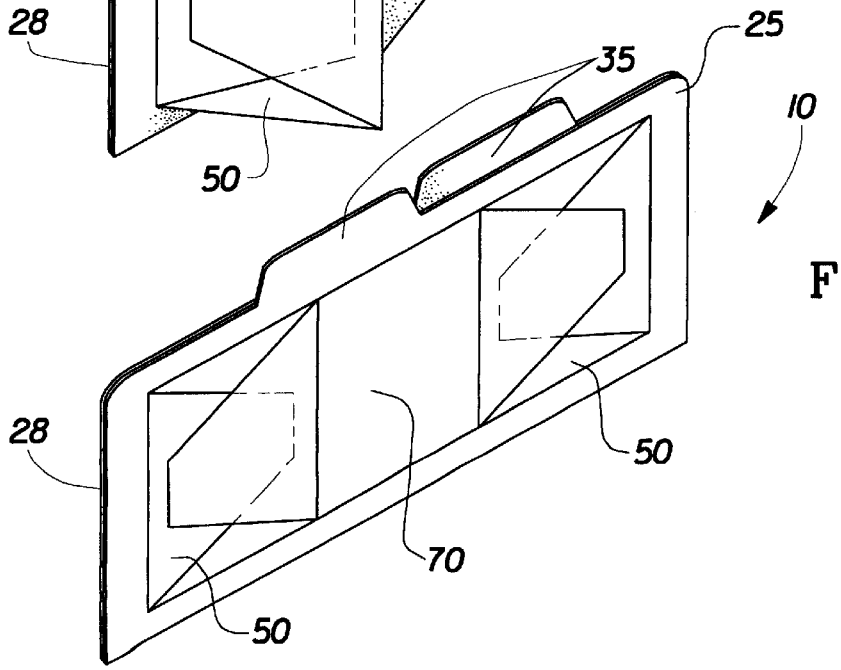
FIG. 5 is a perspective view of the storage container of FIG. 1 in a fully folded and collapsed condition.
Figure 6:
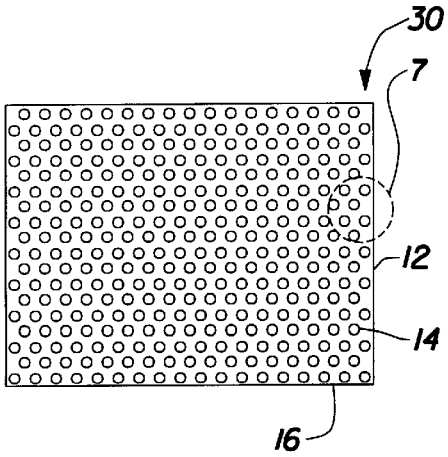
FIG. 6 is a top plan view of a preferred embodiment of a material suitable for use as a closure means of the present invention, disclosing a piece of material having truncated conical protrusions surrounded by an interconnected pattern of substance.
Figure 7:
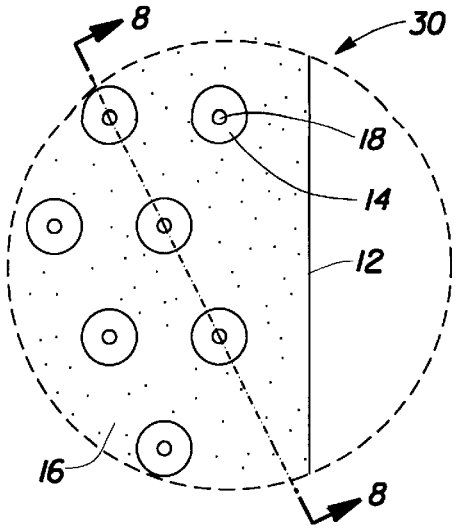
FIG. 7 is an enlarged partial top plan view of the material of FIG. 6, showing an array of protrusions.

In addition to being self-supporting, gusseted storage container 10 is also readily foldable or collapsible to provide easy storage occupying minimal space. FIG. 3 depicts a gusseted storage container 10 as shown in FIG. 1 positioned laterally on its side in preparation for folding. FIG. 4 depicts a gusseted storage container 10 as shown in FIG. 1 but in a partially folded or collapses condition. Accordingly, medial creases 61 have been pushed inwardly toward one another, bringing bottom edges 64 toward and generally parallel to the flange 25 FIG. 5 shows a gusseted storage container 10 in a more fully folded condition wherein folding continues until the bottom 70 is substantially parallel to and in close proximity to the flange 25. Also depicted in FIG. 3 is the optional reinforcing panel 72 which adds additional integrity and stability to the generally rectangular, planar bottom panel 70. To avoid negatively impacting upon the foldability of the container body, the reinforcing bottom panel 72 preferably includes creases 71 which substantially align with lateral creases 63 for folding as depicted in FIGS. 3–5. Optional reinforcing panel 72 may also extend upwardly at one or both ends covering or reinforcing end panels 50.

The addition of additional reinforcement to the bottom panel lowers the center of gravity of the empty container for greater stability prior to and during filling, increases the stiffness of the bottom of the container for added stability in most circumstances filled or empty, and reduces the likelihood of the bottom of the container bowing when filled with heavier contents. The reinforcing panel may be of a similar material to the container body material or may be of a different more or less durable material, and is secured to the bottom panel by adhesive application or other suitable means. It is presently preferred that when a reinforcing panel is employed that it be placed on the exterior surface of the bottom panel rather than on the interior surface in order to provide support and reinforcement without adding additional surfaces, joints, and crevices on the interior of the container where they may provide sites for trapping portions of the contents and creating cleaning difficulties.

The flexible sheet material utilized to form the body of the container is sufficiently flexible and yieldable to accommodate the folding or collapsing of the container body between the open configuration of FIG. 1 and the closed configuration of FIG. 5. More particularly, the side panels 60 are sufficiently flexible to fold or pleat upon themselves as the end panels 50 pivot inwardly toward one another as the bottom panel 70 moves toward the lid 40.

To open the storage container of FIG. 1, a user may grasp the pair of tabs 35 and pull them in opposite directions to initiate and propagate separation of the opposed halves of flange 31, and hence closure means 30.

In FIGS. 1–5, the seam and folding structure of the end panels 50 is clearly visible. Such a folding configuration is typical of conventional folded, gusseted bags having a square or rectangular bottom and is sealed appropriately by adhesives, heat seals, or the like so as to provide a substantially liquid-tight and gas-tight panel structure. The gusseted, pleated sidewall structure with spaced, defined corners adds additional integrity and stability to the filled container, improving stackability in use and adding stability as well in terms of overturning or the like.

More specifically, the manner of folding the container body material to form the end panels 50, as shown in FIGS. 1–5, results in multiple layers of material forming overlapping flaps 51 and 52, which lends additional stability and rigidity to the container when these panels are in their extended position of FIG. 1 since they function as legs or supports for the container. Moreover, the diagonal folded edges of the flaps 51 and 52, namely edges 53, is believed to provide diagonal reinforcing folds or braces which further aid in the construction of end panels 50 from a flexible material which provide the desired level of integrity, self-supportability, and stackability to the container of the present invention.

Various compositions suitable for constructing the storage containers of the present invention include substantially impermeable materials such as polyvinyl chloride (PVC), polyvinylidene chloride (PVDC), polyethylene (PE), polypropylene (PP), aluminum foil, coated (waxed, etc.) and uncoated paper, coated nonwovens etc., and substantially permeable materials such as scrims, meshes, wovens, nonwovens, or perforated or porous films, whether predominantly two-dimensional in nature or formed into three-dimensional structures. Such materials may comprise a single composition or layer or may be a composite structure of multiple materials, including a substrate material utilized as a carrier for a substance. Materials found suitable for use in accordance with the present invention include a low density polyethylene film, 0.006 inch thickness, commercially available from Huntsman Film Products Corp. under the manufacturer's designation X420.

Once the desired sheet materials are manufactured in any desirable and suitable manner, comprising all or part of the materials to be utilized for the container body, the container may be constructed in any known and suitable fashion such as those known in the art for making such bags in commercially available form. Heat or adhesive sealing technologies may be utilized to join various components or elements of the container to themselves or to each other. In addition, the container bodies may be thermoformed, blown, or otherwise molded rather than reliance upon folding and bonding techniques to construct the container bodies from a web or sheet of material.

The closure means depicted in FIGS. 1–5 may be constructed in any known fashion utilizing any closure configuration, such as folds, pleats, adhesives, or mechanical interlocking closures such as ribs, beads, and grooves, which are known in the art. However, it is presently preferred to utilize a selectively activatible adhesive-bearing structure which provides a secure closure seal upon activation. Accordingly, the closure means preferably comprises a selectively activatible adhesive-like material which bonds opposing material surfaces to one another across the opening formed by flange 25 in FIG. 2. The bond between the closure means and a target surface is also sufficient to provide a barrier seal against transmission of oxygen, moisture/moisture vapor, odor, etc. such that perishable items may be satisfactorily enclosed and preserved to the extent of the barrier properties of the material itself The target surface may comprise a separate element of the container or may comprise another region of the closure means itself.

As utilized herein, the term "selectively activatible" is used to refer to materials which exhibit substantially non-adherent properties when brought into contact with target surfaces until some action is taken by a user to "activate" the material to reveal adhesive properties. Accordingly, selectively-activatible properties differ from permanently-active strips of adhesive which rely upon removal of liner materials (typically silicone-coated paper strips) to expose the adhesive for use.

Selective activation of such materials allows the user to properly position opposing surfaces before activation and adhesion are accomplished, as well as minimizing the likelihood of contamination of the closure means by contents during filling operations. This characteristic permits the storage container to be opened, filled, and/or manipulated in any desired mode without encountering the difficulties of premature clinging or adhering of the closure means to itself or to other portions of the opening or container body, and without the need for separate release sheets, liners, spacers, or the like. Preferably, the selective activation process is reversible such that the closure means may be de-activated and the container opened for filling or removal of contents and then re-activated for further closure without significant loss of adhesive capability.

Although material utilized for the closure means may be provided with two active sides or surfaces, if desired for particular applications, in accordance with the present invention it is presently preferred to provide such material with only one active side and one inactive or inert side. While under some circumstances it may be acceptable or desirable to design the closure material so as to form a discontinuous bond pattern with itself or another target surface, such as by having an intermittent or discontinuous layer of adhesive on its active surface, it is presently preferred that the closure material be designed so as to exhibit the ability to form a continuous seal or bond with itself and with any sufficiently continuous target surface.

Various means of activation are envisioned as being within the scope of the present invention, such as: mechanical activation by compression, mechanical activation by tensile forces, and thermal activation. However, it is envisioned that there may be or be developed other means of activation which would trigger an adhesive or adhesive-like character which would be capable of functioning as herein described. In a preferred embodiment the active side is activatible by an externally applied force exerted upon the sheet of material. The force may be an externally applied compressive force exerted in a direction substantially normal to the sheet of material, an externally applied tensile force exerted in a direction substantially parallel to the sheet of material, or a combination thereof.

Regardless of the manner of activation, materials useful as a closure means in accordance with the present invention will exhibit an adhesive, adherent, or tacking character as opposed to merely a clinging or affinity character. As utilized herein, therefore, the term "adhesive" is utilized to refer the ability of a material to exhibit an adherent character whether or not it actually includes a composition commonly understood and labelled as an adhesive. Accordingly, such materials will form a bond or seal when in contact with itself or another target surface as opposed to merely being attracted to such surface. While a number of approaches such as the use of selectively adherent materials may be utilized to provide the desired adhesive properties, a presently preferred approach is to utilize a pressure-sensitive adhesive.

When designing materials useful as a closure means in accordance with the present invention, it may be desirable to tailor the particular choice of adhesive agent so as to provide either a permanent bond or a releasable bond as desired for a particular application. Where a permanent bond is desired, opening of the storage container for access to the item(s) therein requires destruction of the container. Releasable bonds, on the other hand, provide access by permitting separation of the closure means from itself or other portions of the container at the bond site without destruction. Moreover, depending upon the activation mechanism employed in the design of the material, the releasable bond may additionally be refastenable if sufficient adhesive character remains after the initial activation/bonding/release cycle.

The closure materials useful in the present invention exhibit an adhesion sufficient to survive the likely degree of handling and external or internal forces the storage container is likely to encounter in use while maintaining the desired level of sealing engagement with the opposing surface such that preservation of perishable items is ensured. In general, minimum adhesion which maintains a seal is desired for a closure means, so that the closure means easily peeled open for access to the stored item(s). At the same time, in a preferred embodiment the closure means is a substantially clingless material. Suitable methods of measuring and quantifying adhesive and cling properties are described in greater detail in commonly-assigned, co-pending U.S. patent application Ser. No. 08/744,850, filed Nov. 8, 1996 in the names of Hamilton and McGuire, entitled "Material Having A Substance Protected by Deformable Standoffs and Method of Making", the disclosure of which is hereby incorporated herein by reference.

The closure means utilized in accordance with the present invention comprises a sheet of material having a first side and a second side. The first side comprises an active side exhibiting an adhesion peel force after activation by a user which is greater than an adhesion peel force exhibited prior to activation by a user. The active side of the closure means preferably exhibits an adhesion peel force of at least about 1 ounce per linear inch, more preferably between about 1 and about 2.5 ounces per linear inch, after activation by a user.

One such material of current interest for use as a closure material in accordance with the present invention comprises a three-dimensional, conformable web comprising an active substance such as adhesive on at least one surface protected from external contact by the three-dimensional surface topography of the base material. Such materials comprise a polymeric or other sheet material which is embossed/debossed to form a pattern of raised "dimples" on at least one surface which serve as stand-offs to prevent an adhesive therebetween from contacting external surfaces until the stand-offs are deformed to render the structure more two-dimensional. Representative adhesive carrier structures include those disclosed in commonly assigned, co-pending U.S. patent application Ser. No. 08/584,638, filed Jan. 10, 1996 in the names of Hamilton and McGuire, entitled "Composite Material Releasably Sealable to a Target Surface When Pressed Thereagainst and Method of Making", Ser. No. 08/744,850, filed Nov. 8, 1996 in the names of Hamilton and McGuire entitled "Material Having A Substance Protected by Deformable Standoffs and Method of Making", Ser. No. 08/745,339, filed Nov. 8, 1996 in the names of McGuire, Tweddell, and Hamilton, entitled "Three-Dimensional, Nesting-Resistant Sheet Materials and Method and Apparatus for Making Same", Ser. No. 08/745,340, filed Nov. 8, 1996 in the names of Hamilton and McGuire, entitled "Improved Storage Wrap Materials". The disclosures of each of these applications are hereby incorporated herein by reference.

The three-dimensional structure comprises a piece of deformable material which has a first side formed to have a plurality of hollow protrusions separated by valleys. The plurality of hollow protrusions have outermost ends. The piece of material has a second side. The second side has a plurality of depressions therein corresponding to the plurality of hollow protrusions on the first side. The substance adheres to and partially fills the valleys between the plurality of hollow protrusions. The substance has a surface below the outermost ends of the plurality of hollow protrusions, so that when a portion of the first side of the piece of deformable film is placed against a target surface, the plurality of hollow protrusions prevent contact between the substance and the target surface until the portion is deformed at the target surface. Preferably, the plurality of protrusions deform by modes which are selected from the group consisting of inverting, crushing, and elongating. Preferably, in the inverting and/or crushing modes, each of the plurality of protrusions will not substantially deform until exposed to a pressure of at least 0.1 pounds per square inch (0.69 kPa).

FIGS. 6–10 illustrate a preferred embodiment of a material useful as a closure means for flexible storage containers according to the present invention, which comprises a three-dimensional sheet-like structure generally indicated as 30. Material 30 includes a deformed material 12 having hollow protrusions 14 and a layer of substance 16 located between protrusions 14. Protrusions 14 are preferably conical in shape with truncated or domed outermost ends 18. Protrusions 14 are preferably equally spaced in an equilateral triangular pattern, all extending from the same side of the material. Protrusions 14 are preferably spaced center to center a distance of approximately two protrusion base diameters or closer, in order to minimize the volume of valleys between protrusions and hence the amount of substance located between them. Preferably, the protrusions 14 have heights which are less than their diameters, so that when they deform, they deform by substantially inverting and/or crushing along an axis which is substantially perpendicular to a plane of the material. This protrusion shape and mode of deforming discourages protrusions 14 from folding over in a direction parallel to a plane of the material so that the protrusions cannot block substance between them from contact with a target surface.

Figure 8:
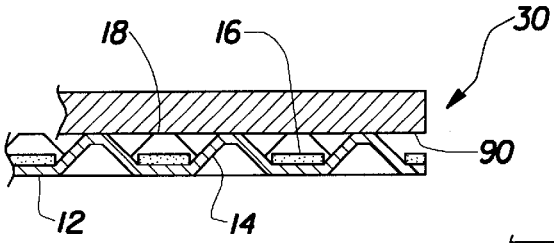
FIG. 8 is an elevational sectional view, taken along section line 8—8 of FIG. 7, showing the protrusions acting as standoffs for a substance layer between protrusions, such that a target surface contacting the outermost ends of the protrusions does not contact the substance layer.
Figure 9:
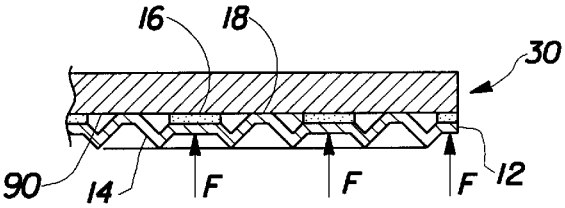
FIG. 9 is an elevational sectional view similar to FIG. 8, showing the effect of pressing the material against the target surface, such that protrusions deform by substantially inverting and/or crushing to allow the substance layer between protrusions to contact the target surface.

FIG. 8 shows a target surface 90, which is smooth but which may have any surface topography, being spaced away from layer of substance 16 by outermost ends 18 of protrusions 14. Target surfaces in accordance with the present invention will typically comprise an opposing portion of the closure periphery which may or may not itself comprise a selectively-activatible adhesive-carrying closure means of similar type. FIG. 9 shows target surface 90 contacting layer of substance 16 after protrusions 14 have been partially deformed under pressure applied to the non-substance side of material 12, as indicated by force F.

The more protrusions per unit area, the thinner the piece of material and protrusion walls can be in order to resist a given deformation force. Preferred layer of substance 16 is preferably a latex pressure sensitive adhesive or a hot melt adhesive, such as that available under specification no. Fuller HL-2115X made by H. B. Fuller Co. of Vadnais Heights, Minn. Any adhesive can be used which suits the needs of the material application. Adhesives may be refastenable, releasable, permanent, or otherwise. The size and spacing of protrusions is preferably selected to provide a continuous adhesive path surrounding protrusions so that air-tight seals may be made with a target surface and a desired level of adhesion with a target surface, while also providing the optimum pattern of standoffs for selective activation.

Film materials may be made from homogeneous resins or blends thereof Single or multiple layers within the film structure are contemplated, whether co-extruded, extrusion-coated, laminated or combined by other known means. The key attribute of the film material is that it be formable to produce protrusions and valleys. Useful resins include polyethylene, polypropylene, PET, PVC, PVDC, latex structures, nylon, etc. Polyolefins are generally preferred due to their lower cost and ease of forming. Other suitable materials include aluminum foil, coated (waxed, etc.) and uncoated paper, coated and uncoated nonwovens, scrims, meshes, wovens, nonwovens, and perforated or porous films, and combinations thereof Different applications for the formed closure means will dictate ideal size and density of protrusions, as well as the selection of the substances used therewith. It is believed that the protrusion size, shape and spacing, the web material properties such as flexural modulus, material stiffness, material thickness, hardness, deflection temperature as well as the forming process determine the strength of the protrusion. A "threshold" protrusion stiffness is required to prevent premature activation of the closure means due to the weight of overlaying layers of sheets or other forces, such as forces induced by shipping vibrations, mishandling, dropping and the like.

Inversion of protrusions minimizes protrusion spring back so that higher adhesion isn't necessary in order to prevent the failure of relatively weak seals. A resilient protrusion could be used, for example, where it is intended for the bond to be permanent, where aggressive adhesive overcomes spring back. Also, a resilient protrusion may be desirable where repeat use of the material is intended.

Figure 10:
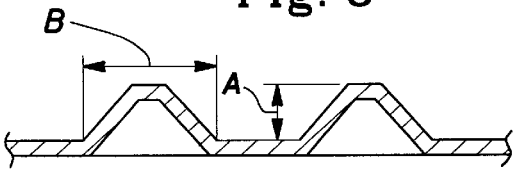
FIG. 10 is an elevational sectional view of the material of FIGS. 6–9, showing preferred dimensional relationships of protrusions.

FIG. 10 shows a preferred shape of the protrusions and valleys of closure means of the present invention, which enables protrusions to substantially invert and/or crush as a mode of deforming. The preferred shape minimizes protrusion fold-over and interference with substance placed in valleys between protrusions, or inside hollow protrusions, or both. Also, the preferred shape helps to ensure a repeatable, predictable, resistance to protrusion deformation. FIG. 10 shows that each protrusion is defined by a height dimension A and a base diameter dimension B. A preferred ratio of base diameter B to height A, which enables protrusions to substantially invert and/or crush without fold-over, is at least 2:1.

Figure 11:
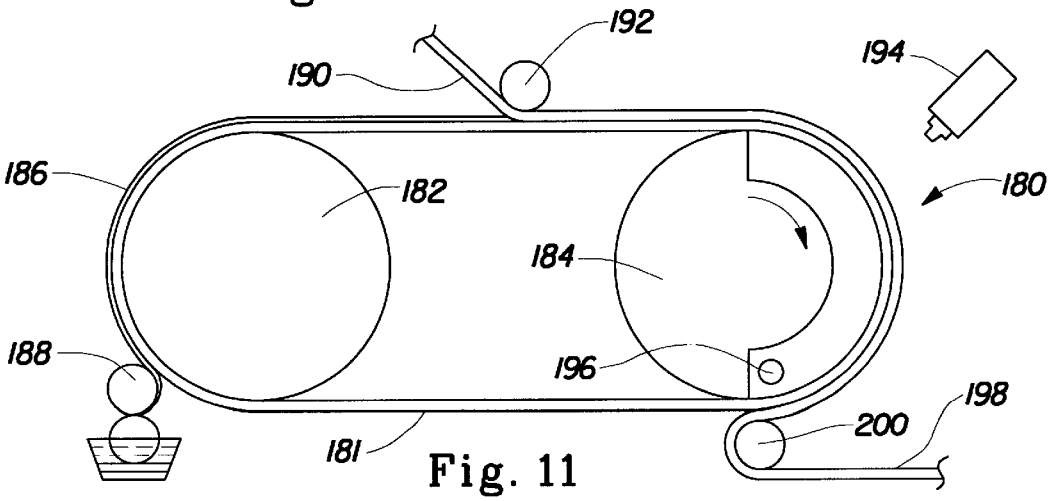
FIG. 11 is a schematic view of a suitable method of making a material suitable for use as a closure means of the present invention, showing a forming screen as a belt wrapped around a vacuum drum and a drive pulley.

FIG. 11 shows a suitable method for making a material such as the material useful in accordance with the present invention, which is generally indicated as 180 in FIG. 11.

The first step comprises coating a forming screen with a first substance. The forming screen has a top surface and a plurality of recesses therein. The coating step applies the first substance to the top surface without bridging the recesses. A second step includes introducing a piece of material, which has a first side and a second side, onto the forming screen such that the first side is in contact with the first substance on the top surface of the forming screen. The first substance preferentially adheres to the first side of the piece of material. A third step includes forming the piece of material to create a plurality of hollow protrusions extending from the first side into the recesses of the forming screen. The plurality of hollow protrusions are spaced apart by valleys into which the first substance is transferred from the forming screen. The plurality of hollow protrusions are accurately registered with the first substance by use of a common transfer and forming surface. The first substance forms an interconnected layer in the valleys between the protrusions.

Forming screen 181 is threaded over idler pulley 182 and a driven vacuum roll 184. Forming screen 181 is preferably a stainless steel belt, having the desired protrusion pattern etched as recesses in the belt. Covering the outer surface of vacuum roll 184 is a seamless nickel screen which serves as a porous backing surface for forming screen 181.

For producing a pressure sensitive adhesive containing material, a substance 186, preferably hot melt adhesive, is coated onto forming screen 181 by a substance applicator 188 while forming screen 181 rotates past the applicator. A web of material 190 is brought into contact with the substance coated forming screen at material infeed idler roll 192. Hot air is directed radially at material 190 by a hot air source 194 as the material passes over vacuum roll 184 and as vacuum is applied to forming screen 181 through vacuum roll 184 via fixed vacuum manifold 196 from a vacuum source (not shown). A vacuum is applied as the material is heated by hot air source 194. A formed, substance coated material 198 is stripped from forming screen 181 at stripping roll 200. Because the same common forming screen is used to transfer the substance to the material as is used to form the protrusions, the substance pattern is conveniently registered with the protrusions.

Stainless steel forming screen 181 is a fabricated, seamed belt. It is fabricated in several steps. The recess pattern is developed by computer program and printed onto a transparency to provide a photomask for photoetching. The photomask is used to create etched and non-etched areas. The etched material is typically stainless steel, but it may also be brass, aluminum, copper, magnesium, and other materials including alloys. Additionally, the recess pattern may be etched into photosensitive polymers instead of metals. Suitable forming structures are described in greater detail in the above-referenced and above-incorporated Hamilton et al. and McGuire et al. patent applications.

Materials of the foregoing variety when utilized as a closure means in accordance with the present invention may be unitarily formed and constructed as part of the body of the storage container either before, during, or after assemblage of the container from its material components. Alternatively, such closure means may also be separately formed and joined to the body of the storage container either before, during or after assemblage of the container. Such joining may be edge-wise or may be accomplished as a lamination or bonding of the material facially onto a superposed portion of the container body, such lamination being particularly advantageous when it is desired to add additional thickness, stiffness, and/or resiliency to the region of the container comprising the closure means. The material utilized for the closure means may be the same as or different from the material utilized to form the container body either in dimensions or in composition.

Particularly useful as a flange material in accordance with the present invention is a self-supporting, semi-rigid, resilient polymeric or coated paper sheet material with a closure means laminated thereto such that the active side of the closure means faces away from the flange material, such that a composite closure means is formed having a plurality of highly-deformable stand-offs with a substantially more resilient, more self-supporting base material.

To facilitate separation of adhered or bonded overlying portions of the closure means material, various adaptations or modifications may be accomplished in terms of integration of the material into the overall structure of the storage container. For example, it may be desirable to provide extension tabs (such as tabs 35 shown in FIGS. 1–5) on opposing sides of the opening periphery to facilitate manual initiation of closure separation. It may also be desirable to leave a small but finite portion of the container immediately adjacent to the opening periphery free of closure material, such that there is a non-adherent rim of material which may be utilized to initiate material separation and hence opening of the storage container.

In accordance with the present invention, the use of selectively-activatible adhesive materials for the closure means 30 provides the user with an easy-to-operate closure means for closing and sealing an opening in a storage container. The closure means 30 is easy to manipulate with one or two hands, as the only dexterity required is to grasp or pinch the closure means with a pair of opposed digits to activate the material against an opposing surface of the container body or closure means. Moving the grasping digits across the extent of the opening provides secure adhesion of the closure means across the extent of the opening, thereby converting the storage container from a semi-enclosed container to a fully closed container. Particularly when the closure means fully encircles the opening in the container body, the closure means 30 is highly tolerant to misalignment as it will adhere to any opposing surface unlike mechanical closure mechanisms which typically require precise alignment of mating elements.

The ability of the closure means to be activated by pinching or grasping superimposed portions of the container body is particularly advantageous with flexible, conformable structures such as the storage containers of the present invention. More particularly, such structures are yieldable under applied forces and accordingly, it would be difficult to activate a seal by exerting pressure upon the container as a whole against a surface, particularly when filled, as such would tend to expel contents as sealing of the closure is attempted. Therefore, the use of a closure means as herein described permits secure, reliable sealing of even highly flexible storage containers.

Because the closure means in a preferred configuration employs a layer of adhesive protected by a plurality of three-dimensional protrusions, rather than a three-dimensional mating pair of interlocking elements, it is possible to employ such a closure means successfully in a confined, non-parallel region of the container such as the region near the hinge 45 without providing leakage sites such as the ends of the mechanical elements. Accordingly, the closure means 30 of the present invention provides additional security and confidence in the level of sealing obtained for situations where a leakproof seal is important.

Although the self-supporting storage containers illustrated in the foregoing FIGS. 1–5 have been constructed of flexible sheet material along the lines of the approach typically taken for paper grocery-type bags, as illustrated for example in U.S. Pat. No. 584,555, issued Jun. 15, 1897 to Lorenz, a wide variety of other constructions may be utilized in keeping with the self-supporting approach in conjunction with the use of a closure means in accordance with the present invention.

In addition to such use of sheet material folded and sealed to form the container body, the container body may be constructed in any known and suitable fashion such as those known in the art for making such containers in commercially available form. Heat or adhesive sealing technologies may be utilized to join various components or elements of the container to themselves or to each other. In addition, the container bodies may be thermoformed, blown, or otherwise molded from a starting blank or sheet of material rather than reliance upon folding and bonding techniques to construct the container bodies from a web or sheet of material.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A collapsible, foldable, stackable, and self-supportable container having collapsible and non-collapsible states, said container comprising:

(a) a semi-enclosed containers body comprising two opposed side walls, two opposed end walls between said side walls, said side walls and said end walls together forming a tubular structure having two open ends, and a bottom panel enclosing one end of said container body, the other end of said tubular structure opposite from said bottom panel forming a periphery, each of said side walls including a gusset extending in a direction substantially parallel to said bottom panel;

(b) a lid for selectively converting said semi-enclosed container to a closed container; and (c) a closure means for sealing said lid to said container body, said closure means extending beyond the side and end walls of the container when said container is in its collapsed and non-collapsed states;

wherein said side walls and said end walls are inwardly foldable toward one another, such that said container is collapsible in a direction normal to said lid and said bottom panel while being substantially self-supporting while said side walls and said end walls are in their unfolded orientation.

2. The collapsible, foldable, stackable, and self-supporting container of claim 1 wherein said lid is attached to said container body.

3. The collapsible, foldable, stackable, and self-supporting container of claim 1, wherein said container body includes a substantially continuous outwardly-extending flange forming said periphery.

4. The collapsible, foldable, stackable, and self-supporting container of claim 3, wherein said lid is unitarily formed with said flange.

5. The collapsible, foldable, stackable, and self-supporting container of claim 1, wherein said closure means comprises a piece of material forming at least a portion of said periphery, said piece of material having a first side facing inwardly toward said opening and a second side facing outwardly of said opening, said first side exhibiting an adhesion peel force after activation by a user which is greater than an adhesion peel force exhibited prior to activation by a user.

6. The collapsible, foldable, stackable, and self-supportable container of claim 1, wherein said side walls, said end walls, and said bottom panel are unitarily formed from a continuous sheet of material.

7. The collapsible, foldable, stackable, and self-supportable container of claim 1, wherein said closure means is activatible by an externally applied force exerted upon said piece of material.

8. The collapsible, foldable, stackable, and self-supportable container of claim 3, wherein said closure means is activatible by an externally applied compressive force exerted in a direction substantially parallel to said opening plane.

9. The collapsible, foldable, stackable, and self-supportable container of claim 1, wherein said closure means is clingless and exhibits no adhesion peel force prior to activation by a user.

10. The collapsible, foldable, stackable, and self-supportable container of claim 1, wherein said piece of material forms substantially all of said periphery.

11. The collapsible, foldable, stackable, and self-supportable container of claim 1, wherein said closure means is unitarily formed from said sheet material.

12. The collapsible, foldable, stackable, and self-supportable container of claim 1, wherein said closure means comprises a separate material element joined to said sheet material.

13. The collapsible, foldable, stackable, and self-supportable container of claim 1, wherein said closure means comprises a three-dimensional sheet material which is convertible to a substantially two-dimensional sheet material upon activation by a user to expose an adhesive layer to contact with a complementary surface of said semi-enclosed container across said opening.

14. The collapsible, stackable, self-supportable container of claim 1, wherein said closure means comprises a portion of said lid.

15. The collapsible, stackable, self-supportable container of claim 1, wherein said closure means comprises a portion of said flange.

16. The collapsible, stackable, self-supportable container of claim 1, wherein said closure means comprises portions of said lid and said flange.

17. The collapsible, stackable, self-supportable container of claim 1, wherein said lid comprises a central lid panel and a lid frame.

18. The collapsible, stackable, self-supportable container of claim 1, wherein said tubular structure has a substantially rectangular cross-sectional shape.

19. The collapsible, stackable, self-supportable container of claim 1, wherein said lid is joined to said flange by a living hinge.

20. The collapsible, stackable, self-supportable container of claim 1, wherein said end panels include diagonal reinforcing folds.

21. A collapsible, foldable, stackable, and self-supportable container having collapsible and non-collapsible states, said container comprising:

(a) a semi-enclosed container body comprising two opposed side walls, two opposed end walls between said side walls, said side walls and said end walls together forming a tubular structure having two open ends, and a bottom panel enclosing one end of said container body, the other end of said tubular structure opposite from said bottom panel forming a periphery, each of said side walls including a gusset extending in a direction substantially parallel to said bottom panel;

(b) a lid attached to said periphery for selectively converting said semi-enclosed container to a closed container; and (c) a closure means for sealing said lid to said container body, said closure means extending beyond the side and end walls of the container when said container is in its collapsed and non-collapsed states, wherein said closure means comprises a piece of material forming at least a portion of said periphery, said piece of material having a first side facing inwardly toward said opening and a second side facing outwardly of said opening, said first side exhibiting an adhesion peel force after activation by a user which is greater than an adhesion peel force exhibited prior to activation by a user;

wherein said side walls and said end walls are inwardly foldable toward one another, such that said container is collapsible in a direction normal to said lid and said bottom panel while being substantially self-supporting while said side walls and said end walls are in their unfolded orientation.

22. A collapsible, foldable, stackable, and self-supportable container having collapsible and non-collapsible states, said container comprising:

(a) a semi-enclosed container body comprising two opposed side walls, two opposed end walls between said side walls, said side walls and said end walls together forming a tubular structure having two open ends, and a bottom panel enclosing one end of said container body, the other end of said tubular structure opposite from said bottom panel including a substantially continuous outwardly-extending flange forming a periphery, each of said side walls including a gusset extending in a direction substantially parallel to said bottom panel;

(b) a lid attached to said flange for selectively converting said semi-enclosed container to a closed container; and (c) a closure means for sealing said lid to said flange, said closure means extending beyond the side and end walls of the container when said container is in its collapsed and non-collapsed states, wherein said closure means comprises a piece of material forming at least a portion of said periphery, said piece of material having a first side facing inwardly toward said opening and a second side facing outwardly of said opening, said first side exhibiting an adhesion peel force after activation by a user which is greater than an adhesion peel force exhibited prior to activation by a user;

wherein said side walls and said end walls are inwardly foldable toward one another, such that said container is collapsible in a direction normal to said lid and said bottom panel while being substantially self-supporting while said side walls and said end walls are in their unfolded orientation.

* * * * *